US010150713B2

(12) United States Patent
Doud et al.

(10) Patent No.: US 10,150,713 B2
(45) Date of Patent: Dec. 11, 2018

(54) FLUID ACTIVATED DISINTEGRATING METAL SYSTEM

(71) Applicant: Terves, Inc., Euclid, OH (US)

(72) Inventors: Brian Doud, Cleveland Heights, OH (US); Andrew Sherman, Mentor, OH (US); Nicholas Farkas, Euclid, OH (US); Brian Werry, Euclid, OH (US)

(73) Assignee: Terves, Inc., Euclid, OH (US)

( * ) Notice: Subject to any disclaimer, the term of this patent is extended or adjusted under 35 U.S.C. 154(b) by 754 days.

(21) Appl. No.: 14/627,189

(22) Filed: Feb. 20, 2015

(65) Prior Publication Data

US 2015/0239795 A1 Aug. 27, 2015

Related U.S. Application Data

(60) Provisional application No. 61/942,870, filed on Feb. 21, 2014, provisional application No. 62/054,597, filed on Sep. 24, 2014.

(51) Int. Cl.

| | |
|---|---|
| ***C06B 45/18*** | (2006.01) |
| ***C06B 45/32*** | (2006.01) |
| ***E21B 33/12*** | (2006.01) |

(52) U.S. Cl.

CPC ..... *C06B 45/32* (2013.01); *C06B 45/18* (2013.01); *E21B 33/12* (2013.01); *Y10T 428/12729* (2015.01); *Y10T 428/31605* (2015.04); *Y10T 428/31692* (2015.04)

(58) Field of Classification Search

CPC combination set(s) only.
See application file for complete search history.

(56) References Cited

U.S. PATENT DOCUMENTS

| | | | |
|---|---|---|---|
| 3,180,728 | A | 4/1965 | Pryor et al. |
| 3,445,731 | A | 5/1969 | Saeki et al. |
| 4,264,362 | A | 4/1981 | Sergev et al. |

(Continued)

FOREIGN PATENT DOCUMENTS

| | | |
|---|---|---|
| CN | 10138129 | 3/2009 |
| CN | 102517489 | 6/2012 |

(Continued)

OTHER PUBLICATIONS

Galaev et al., "Smart Polymers for Bioseparation and Biopolymers", Nov. 15, 2001, CRC Press, p. 71. (Year: 2001).*

(Continued)

*Primary Examiner* — Humera N Sheikh
*Assistant Examiner* — Xiaobei Wang
(74) *Attorney, Agent, or Firm* — Fay Sharpe LLP

(57) ABSTRACT

An engineered composite system designed to be passive or inert under one set of conditions, but becomes active when exposed to a second set of conditions. This system can include a dissolving or disintegrating core, and a surface coating that has higher strength or which only dissolves under certain temperature and pH conditions, or in selected fluids. These reactive materials are useful for oil and gas completions and well stimulation processes, enhanced oil and gas recovery operations, as well as in defensive and mining applications requiring high energy density and good mechanical properties, but which can be stored and used for long periods of time without degradation.

25 Claims, 2 Drawing Sheets

(56) References Cited

U.S. PATENT DOCUMENTS

| | | | | |
|---|---|---|---|---|
| 4,875,948 | A | 10/1989 | Verneker | |
| 5,106,702 | A | 4/1992 | Walker et al. | |
| 6,422,314 | B1 | 7/2002 | Todd et al. | |
| 6,444,316 | B1 | 9/2002 | Reddy et al. | |
| 6,527,051 | B1 | 3/2003 | Reddy et al. | |
| 6,554,071 | B1 | 4/2003 | Reddy et al. | |
| 6,737,385 | B2 | 5/2004 | Todd et al. | |
| 7,647,964 | B2 | 1/2010 | Akbar et al. | |
| 7,999,987 | B2 | 8/2011 | Dellinger et al. | |
| 8,211,247 | B2 | 7/2012 | Marya et al. | |
| 8,211,248 | B2 | 7/2012 | Marya | |
| 8,211,331 | B2 | 7/2012 | Jorgensen et al. | |
| 8,327,931 | B2 | 12/2012 | Agrawal et al. | |
| 8,403,037 | B2 | 3/2013 | Agrawal et al. | |
| 8,413,727 | B2 | 4/2013 | Holmes | |
| 8,425,651 | B2 | 4/2013 | Xu et al. | |
| 8,485,265 | B2 | 7/2013 | Marya et al. | |
| 8,528,633 | B2 | 9/2013 | Agrawal et al. | |
| 8,573,295 | B2 | 11/2013 | Johnson et al. | |
| 8,631,876 | B2 | 1/2014 | Xu et al. | |
| 8,663,401 | B2 | 3/2014 | Marya et al. | |
| 8,714,268 | B2 | 5/2014 | Agrawal et al. | |
| 8,905,147 | B2 | 12/2014 | Fripp et al. | |
| 2002/0102179 | A1 | 8/2002 | Murai | |
| 2002/0121081 | A1 | 9/2002 | Cesaroni et al. | |
| 2003/0173005 | A1 | 9/2003 | Higashi | |
| 2005/0194141 | A1 | 9/2005 | Sinclair et al. | |
| 2006/0175059 | A1 | 8/2006 | Sinclair et al. | |
| 2006/0207387 | A1 | 9/2006 | Soran et al. | |
| 2007/0181224 | A1 | 8/2007 | Marya et al. | |
| 2008/0041500 | A1 | 2/2008 | Bronfin | |
| 2008/0200352 | A1* | 8/2008 | Willberg | C09K 8/508 507/219 |
| 2009/0116992 | A1 | 5/2009 | Lee | |
| 2009/0226340 | A1 | 9/2009 | Marya | |
| 2011/0135530 | A1 | 6/2011 | Xu et al. | |
| 2011/0221137 | A1 | 9/2011 | Obi et al. | |
| 2012/0080189 | A1 | 4/2012 | Marya et al. | |
| 2012/0156087 | A1 | 6/2012 | Kawabata | |
| 2012/0177905 | A1 | 7/2012 | Seals et al. | |
| 2012/0190593 | A1 | 7/2012 | Soane et al. | |
| 2012/0318513 | A1 | 12/2012 | Mazyar et al. | |
| 2013/0022832 | A1* | 1/2013 | Guest | E21B 33/1208 428/610 |
| 2013/0029886 | A1 | 1/2013 | Mazyar et al. | |
| 2013/0032357 | A1* | 2/2013 | Mazyar | E21B 41/00 166/376 |
| 2013/0056215 | A1 | 3/2013 | Crews | |
| 2013/0068411 | A1 | 3/2013 | Forde et al. | |
| 2013/0160992 | A1 | 6/2013 | Agrawal et al. | |
| 2013/0168257 | A1 | 7/2013 | Mazyar et al. | |
| 2013/0199800 | A1 | 8/2013 | Kellner et al. | |
| 2013/0206425 | A1* | 8/2013 | Mazyar | E21B 33/12 166/376 |
| 2013/0220496 | A1 | 8/2013 | Bang | |
| 2013/0261735 | A1 | 10/2013 | Pacetti | |
| 2014/0093417 | A1 | 4/2014 | Liu | |
| 2014/0190705 | A1 | 7/2014 | Fripp | |
| 2014/0202284 | A1 | 7/2014 | Kim | |
| 2014/0219861 | A1 | 8/2014 | Han | |
| 2014/0236284 | A1 | 8/2014 | Stinson | |
| 2015/0299838 | A1 | 10/2015 | Doud | |
| 2016/0024619 | A1 | 1/2016 | Wilks | |

FOREIGN PATENT DOCUMENTS

| | | |
|---|---|---|
| CN | 102796928 | 11/2012 |
| CN | 203343271 | 10/2013 |
| EP | 2088217 | 8/2009 |
| JP | 2008266734 | 11/2008 |
| JP | 2012197491 | 10/2012 |
| JP | 2013019030 | 1/2013 |
| JP | 2014043601 | 3/2014 |
| WO | 199002655 | 3/1990 |
| WO | 1992000961 | 8/1992 |
| WO | 2012047379 | 2/2013 |
| WO | 2023047167 | 2/2013 |
| WO | 2013122712 | 8/2013 |
| WO | 2013154634 | 10/2013 |

OTHER PUBLICATIONS

TMS, "Magnesium Die Casting Alloy Compositions", http://www.tms.org/Communities/FTAttachments/DiecastingCompositionsREV.pdf, accessed May 1, 2018.*

U.S. Search Authority, International Search Report and Written Opinion for corresponding PCT Application No. PCT/US2015/016770, dated Jun. 29, 2015.

Elemental Charts from chemicalelements.com; retrieved Jul. 27, 2017.

Sigworth et al., "Grain Refinement of Aluminum Castings Alloys" American Foundry Society; Paper 07-067; pp. 5, 7 (2007).

Momentive, "Titanium Diborid Powder" condensed product brochure; retrieved from https://www.momentive.com/WorkArea/DownloadAsset.aspx?id+27498>; p. 1 (2012).

Durbin, "Modeling Dissolution in Aluminum Alloys" Dissertation for Georgia Institute of Technology; retrieved from https://smartech;gatech/edu/bitstream/handle/1853/6873/durbin_tracie_L_200505_phd.pdf> (2005).

Peguet et al., "Influence of cold working on the pitting corrosion resistance of stainless steel" Corrosion Science, vol. 49, pp. 1933-1948 (2007).

Song et al., "Corrosion Mechanisms of Magnesium Alloys" Advanced Engg Materials, vol. 1, No. 1 (1999).

Zhou et al., "Tensile Mechanical Properties and Strengthening Mechanism of Hybrid Carbon Nanotubes . . . " Journal of Nanomaterials, 2012; 2012:851862 (doi: 10.1155/2012/851862) Figs. 6 and 7.

Trojanova et al., "Mechanical and Acoustic Properties of Magnesium Alloys . . . " Light Metal Alloys Application, Chapter 8, Published Jun. 11, 2014 (doi: 10.5772/57454) p. 163, para. [0008], [0014-0015]; [0041-0043].

AZoNano "Silicon Carbide Nanoparticles—Properties, Applications" http://www.amazon.com/articles.aspx?ArticleD=3396) p. 2, Physical Properties, Thermal Properties (May 9, 2013).

AZoM "Magnesium AZ91D-F Alloy" http://www.amazon.com/articles.aspx?ArticleD=8670) p. 1, Chemical Composition; p. 2 Physical Properties (Jul. 31, 2013.

Elasser et al., "Silicon Carbide Benefits and Advantages . . . " Proceedings of the IEEE, 2002; 906(6):969-986 (doi: 10.1109/JPROC.2002.1021562) p. 970, Table 1.

Lan et al., "Microstructure and Microhardness of SiC Nanoparticles . . . " Materials Science and Engineering A; 386:284-290 (2004).

Casati et al., "Metal Matrix Composites Reinforced by Nanoparticles", vol. 4:65-83 (2014).

* cited by examiner

FLUID ACTIVATED DISINTEGRATING METAL SYSTEM

The present invention claims priority on U.S. Provisional Application Ser. Nos. 61/942,870 filed Feb. 21, 2014 and 62/054,597 filed Sep. 24, 2014, both of which are incorporated herein by reference.

FIELD OF THE INVENTION

The present invention relates to the formation of disintegrating components and materials that can be stored indefinitely or near indefinitely unless activated. The present invention also relates to the production of a reactive composite having controlled reaction kinetics catalyzed by an external stimulus. The invention further relates to a reactive composite system that is inert unless initiated by a certain temperature, pH, and/or other external stimulus after, which it disintegrates in a controlled and repeatable manner.

BACKGROUND OF THE INVENTION

Reactive materials, which dissolve or corrode when exposed to acid, salt, or other wellbore conditions, have been proposed for some time. Generally, these consist of materials that are engineered to dissolve or corrode. Dissolving polymers have been disclosed and are also used extensively in the pharmaceutical industry for controlled-release drugs. In addition, reactive metal matrix composites have been proposed for use in disintegrating metallic systems, primarily consisting of magnesium-graphite systems, but also magnesium-calcium and other material systems that do not passivate and hence corrode in a rapid manner when in contact with a cathode material, such as graphite or iron.

While some of these systems have enjoyed modest success in reducing well completion costs, they have significant drawbacks, including limited strength and poor reliability. Ideally, components could be used, stored, and handled for long periods of time prior to use and, once activated, can undergo highly reliable disintegration or some other action.

SUMMARY OF THE INVENTION

The present invention relates to the formation of disintegrating components and materials that can be stored for long periods of time (e.g., at least a month, at least a year, etc.) unless activated. The present invention also relates to the production of a reactive composite having controlled reaction kinetics that can be catalyzed by an external stimulus. The invention further relates to a reactive composite system that is inert or essentially inert unless initiated by a certain temperature, pH, and/or other external stimulus after which it disintegrates in a controlled and repeatable manner. In one non-limiting application of the present invention, the components of the present invention can be used in the forming of wells used in, but not limited to, the oil and gas fracking industry. During the formation of wells, various metal components used to form the well are left in the well. These components must either be removed from the well or destroyed before the well can be fully and/or properly operational. The present invention is directed to components that can be used during the well forming operation and, once the component has completed its intended used, the component can be caused to disintegrate and/or fracture, thus sufficiently removing and/or fracturing the component so that the well can be fully and/or properly operational.

In one non-limiting aspect of the present invention relates to a hierarchically-designed component or system that includes a core and a surface which are designed to react and/or activate under different conditions. The core material is designed to have a high reaction rate that disintegrates over a period of 0.001 minutes to 100 hours (e.g., 0.001 min., 0.0011 min., 0.0012 min. . . . 99.99998 hours, 99.99999 hours, 100 hours, and all time values and ranges therebetween), and typically 30 minutes to 100 hours when exposed to certain environments (e.g., saltwater, electrolyte solutions, water, air, electromagnetic waves, sound waves, etc.). The core is typically designed to generate heat when exposed to various environments (e.g., saltwater, electrolyte solutions, water, air, electromagnetic waves, sound waves, etc.). The core can be formed of one or more layers. The shape of the core is non-limiting. The core is partially or fully surrounded by one or more surface or protective layers that inhibits or prevents the core from reacting and/or disintegrating until a desired time or event. The one or more surfaces or protective layers are designed to be inert unless exposed to an activation conditions such as, but not limited to, temperature, electromagnetic waves, sound waves, certain chemicals, and/or pH. Once the one or more surface or protective layers are removed and/or breached, the core material is activated to cause it to dissolve, corrode, react, fracture, etc. when exposed to certain surrounding conditions. For example, in a well application, the component is partially or fully submersed in a liquid environment that commonly includes water and/or saltwater/electrolytes. The core can be designed to dissolve, corrode, react, fracture, etc. when exposed to the water and/or to saltwater/electrolytes (e.g., HCl, KCl, $CaCl_2$, $CaBr_2$, $ZnBr_2$, brine solutions) in the well once the one or more surface or protective layers about the core are removed and/or breached, thereby causing the component to dissolve or disintegrate in the well. The one or more surface or protective layers can also or alternatively be used to provide structural strength to the hierarchically-designed component.

In another non-limiting aspect of the present invention, the hierarchically-designed component or system can include one or more outer surface or protective layers and a core that is formed of two or more layers. Each layer can have a different function in the component or system; however, this is not required. In one non-limiting configuration, the component or system can include a surface or protective layer that encapsulates a core which is formed of at least two layers. In such an arrangement, the inner layer of the core can be a syntactic or very low-density core; the layer about the inner core layer can be a disintegrating high-strength functional layer; and the surface or protective layer is one or more layers that function as a surface modification layer and/or treatment which is inert unless activated.

In still another non-limiting aspect of the present invention, there is provided a surface-inhibited multilayer, multifunctional component comprising (a) a primary or core unit which includes one or more selected properties of density, dissolution rate, disintegration rate, reaction rate, strength; (b) a reactive surface layer having a complimentary set of properties of one or more of strength, temperature-dependent solubility, pH solubility, and density; and wherein the core unit and surface layer create an inhibited system that is relatively inert until exposed to an initial condition, after which it is activated. In one non-limiting embodiment, at least 70 weight percent of the core includes a core material selected from the group consisting of a metal, a metal alloy or a metal composite, typically at least 90 weight percent of the core includes a core material selected from the group consisting of a metal, a metal alloy or a metal composite, more typically at least 95 weight percent of the core includes a core material selected from the group consisting of a metal, a metal alloy or a metal composite, and even more typically 100 weight percent of the core includes a core material selected from the group consisting of a metal, a metal alloy or a metal composite. The core can be a magnesium, magnesium alloy or magnesium composite having a dissolution rate in salt-containing water of 0.1-100 mm/hr (e.g., 0.1 mm/hr, 0.101 mm/hr, 0.102 mm/hr . . . 99.998 mm/hr, 99.999 mm/hr, 100 mm/hr and all dissolution values and ranges therebetween) at 100-300° F. (and all temperature values and ranges therebetween). When the core is formed of magnesium, the core includes at least 99 wt % magnesium, and typically at least 99.5 wt % magnesium. When the core is formed of a magnesium alloy, the magnesium content of the magnesium alloy is at least 30 wt %, typically greater than 50%, and more typically at least about 70%. The metals that can be included in the magnesium alloy can include, but are not limited to, aluminum, calcium, lithium, manganese, rare earth metal, silicon, SiC, yttrium, zirconium and/or zinc. As can be appreciated, the core can be formed of other metals and/or non-metals that react, corrode, dissolve or disintegrate at a rate of 0.1-100 mm/hr at 100-300° F. in water or salt water. Non-limiting examples of metals or metal alloys other than magnesium that can be used include aluminum alloys (e.g., aluminum alloys including 75+% aluminum and one or more of bismuth, copper, gallium, magnesium, indium, silicon, tin, and/or zinc); calcium; Ca—Mg, Ca—Al; and Ca—Zn. The core can be formulated and/or designed to be relatively insoluble at one temperature (e.g., room temperature: 60-80° F.), but highly soluble above a certain temperature (e.g., 100° F. or greater). Likewise, the core can also or alternatively be formulated and/or designed to be relatively insoluble in a solution having a certain pH (e.g., acidic pH, basic pH, etc.), but highly soluble in a solution having a different pH. When the component includes a surface coating, the surface coating can be designed to be relatively insoluble at a first temperature (e.g., room temperature, etc.), but highly soluble above or below above the first temperature. The surface layer can be formed of a metal coating (e.g., zinc, zinc alloy, etc.) and/or a polymer coating. In one non-limiting example, a surface layer that is relatively insoluble has a dissolution rate of about 0-0.1 mm/day (all dissolution values and ranges therebetween). In another non-limiting example, a surface layer that is highly soluble has a dissolution rate of 0.1 mm/hr or greater (e.g., 0.1 mm/hr 50 mm/hr and all dissolution values and ranges therebetween). Likewise, the surface layer (when used) can also or alternatively be formulated and/or designed to be relatively insoluble in a solution having a certain pH (e.g., acidic pH, basic pH, etc.), but highly soluble in a solution having a different pH. Non-limiting examples of polymers that can be used include ethylene-α-olefin copolymer; linear styrene-isoprene-styrene copolymer; ethylene-butadiene copolymer; styrene-butadiene-styrene copolymer; copolymer having styrene endblocks and ethylene-butadiene or ethylene-butene midblocks; copolymer of ethylene and alpha olefin; ethylene-octene copolymer; ethylene-hexene copolymer; ethylene-butene copolymer; ethylene-pentene copolymer; ethylene-butene copolymer; polyvinyl alcohol (PVA); and/or polyvinyl butyral (PVB). Also or alternatively, when the component includes a surface layer, the surface layer can include a chemistry that enables the surface layer to be an insoluble layer and then become a soluble layer when reacted with one or more compounds. For example, when the surface layer includes PVA, PVB, and/or similar polymers, the surface layer can be modified using a reversible chemical reaction to be insoluble in high-temperature water, acidic water solutions and/or salt water solutions, and which is soluble in high-temperature water, acidic water solutions and salt water solutions when a chemical trigger is applied. The reversible chemical reaction to make the surface layer insoluble can use trimethylsilyl group or similar silicon-containing organic chemicals. The reversible chemical reaction to make the surface layer soluble again can use ammonium fluoride or a similar compound. This non-limiting type of reversible chemistry is illustrated below:

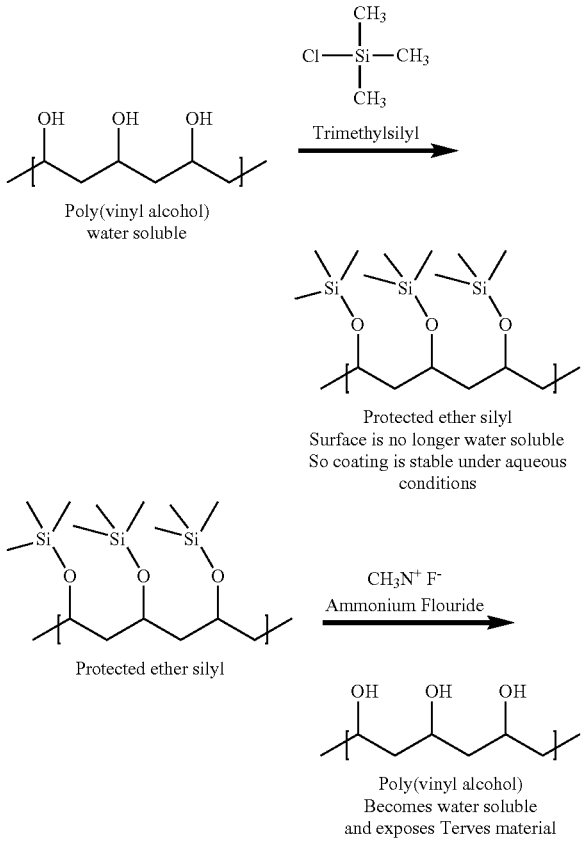

As set forth above, PVA, a compound that is soluble in water, can be made insoluble in water by reacting the PVA with trimethylsilyl group or some similar compound to form an insoluble compound in water. This reaction can take place prior to, during, and/or after the PVA (i.e., surface layer) is applied to the core of the component. The core of the component or a portion of the core of the component can be formed of a material (e.g., magnesium, magnesium alloy, etc.) that reacts, corrodes, dissolves, fractures, etc. when exposed to water. The modified surface layer that is insoluble to water protects the core from the water and inhibits or prevents the core from interacting with the water while the component is being used in the presence of water. Once the function or task of the component is completed, the component can be simply dissolved, corroded, fractured, disintegrated, etc. by exposing the water-insoluble surface layer to ammonium fluoride or a similar compound. Such exposure causes the surface layer to once again become a water-soluble compound. When the component is in the presence of water, the surface layer dissolves and the core is eventually exposed to the water. Upon exposure to water, the core dissolves, corrodes, fractures, disintegrates, etc. thereby causing the component to also dissolve, fracture, corrode, disintegrate, etc. The thickness of the surface layer and/or degree of solubility of the surface layer can be selected to control the rate at which the component dissolves, corrodes, fractures, disintegrates, etc. Likewise, the type of material used for the core and/or structure of the core can be selected to control the rate at which the component dissolves, corrodes, fractures, disintegrates, etc.

In yet another non-limiting aspect of the present invention, the surface layer can optionally be formed of a material that that resists degradation and/or dissolving when exposed to HCl (e.g., 0.1-3M HCl), KCl (e.g., 0.1-3M KCl), $CaCl_2$ (e.g., 0.1-3M $CaCl_2$), $CaBr_2$ (e.g., 0.1-3M $CaBr_2$), $ZnBr_2$ (e.g., 0.1-3M $ZnBr_2$), or brine solutions (1000-300,000 ppm) at a temperature of up to 60° F., but degrades and/or dissolves at a higher temperature of at least 100° F. In one specific surface layer, the surface layer resists HCl, KCl, and/or brine solutions up to 300° F., but degrades when a trigger (e.g., chemical ion source, fluorine ion source, etc.) is introduced to the solution in contact with the coating. One such coating is silicone-based coating (e.g., polymer-based siloxane two-part coating, 2-part epoxy-siloxane coating cured with amino silane, etc.). When the trigger is a fluorine ion source, the source of the fluorine ion can optionally be HF, ammonium flouride, or other ionic compound where the fluorine ion will appear in a water solution.

In still yet another non-limiting aspect of the present invention, the surface layer can be applied to the core in a variety of ways (gas deposition, sublimation, solvent application, powder coating, plasma spraying, spraying, dipping, brushing, etc.).

In another non-limiting aspect of the present invention, the surface layer can be a polyurethane base system.

In still another non-limiting aspect of the present invention, the surface layer can be colored using dies for identification of the type of coating, type of core, type of trigger required, and/or type of hierarchically-designed component or system. In one non-limiting coating application process, an electrostatic coating and thermal curing using either a thermoset or thermoplastic polymer coating is used. Such a coating process is known in the industry as a type of "powder coating."

In still yet another non-limiting aspect of the present invention, there is provided a hierarchically-designed component or system in the form of a low-density reactive hierarchically-designed component or system that includes (a) a core having a compression strength above about 5000 psig (e.g., 5000-30,000 psig and all values or ranges therebetween), but having a low density and tensile strength below 30,000 psig (e.g., magnesium composite, aluminum composite, manganese composite, zinc composite, etc.); and (b) a high-strength surface layer that has a higher density and higher strength than the core, but is also reactive (e.g., zinc or zinc alloy composite, etc.) and wherein the core and surface layer are designed to provide a high strength reactive system that also has an overall density of no more than about 5 g/cc (e.g., 0.5-5 g/cc and all values and ranges therebetween) and a tensile strength in the surface layer at least 32 ksi (e.g., 32-90 ksi and all values and rages therebetween). In one non-limiting configuration, the core has a density of about 0.9-1.4 g/cc. When the core is a magnesium composite, aluminum composite, manganese composite, or a zinc composite, the core can be formed of particles that are connected together by a binder. The core particles can include iron particles, carbon particles, tungsten particles, silicon particles, boron particles, tantalum particles, aluminum particles, zinc particles, iron particles, copper particles, molybdenum particles, silicon particles, ceramic particles, cobalt particles, nickel particles, rhenium particles, SiC particles, etc. (includes oxides and carbides thereof) having an average particle diameter size of about 5 to 50 microns (e.g., 5 microns, 5.01 microns, 5.02 microns . . . 49.98 microns, 49.99 microns, 50 microns) and any value or range therebetween, that are coated with about 0.3 to 3 microns coating thickness (e.g., 0.3 microns, 0.301 microns, 0.302 microns . . . 2.998 microns, 2.999 microns, 3 microns) and any value or range therebetween, of a matrix of magnesium, magnesium alloy, aluminum, aluminum alloy, manganese, manganese alloy, zinc and/or zinc alloy. The magnesium composite, aluminum composite, manganese composite, or zinc composite can be formulated to react when activated by an electrolyte (e.g., HCl, KCl, $CaCl_2$, $CaBr_2$, $ZnBr_2$, or brine solutions), heat, etc., with the reactive binder dissolving at a controlled rate. In one non-limiting configuration, the surface layer is a high-strength zinc alloy. In another non-limiting configuration, the core can have a dissolution rate in salt-containing water of 0.1-100 mm/hr at 100-300° F. In another non-limiting configuration, the surface layer can include a fiber-reinforced metal (e.g., steel wire, graphite fiber reinforced magnesium, etc.) to obtain the desired strength of the surface layer.

In another non-limiting aspect of the present invention, there is provided a reactive hierarchically-designed component or system that includes (a) a core having an active material, and a material that is reactive in a fluid; (b) a selectively reactive surface layer that is unreactive in the a first fluid or first fluid conditions, but dissolves or reacts in a second fluid or a condition different from the first fluid condition; and wherein the core is coated with the selectively reactive surface layer, and wherein the core is formed of a different material from the selectively reactive surface layer, and the coating thickness of the selectively reactive surface layer is less than a diameter of the core. The core can include propellant. In one non-limiting configuration, the core includes a water-reactive material such as lithium, sodium, potassium, lithium aluminum hydride, sodium aluminum hydride, potassium aluminum hydride, magnesium aluminum hydride, lithium borohydride, sodium borohydride, calcium borohydride, magnesium hydride, n-Al, borohydride mixed with alanates, metal hydrides, borohydrides, divalent cation alanates, and/or other water-reactive materials. The surface layer is formulated to protect or insulate the core from external environments wherein the core would be reactive to the external environment. In one non-limiting configuration, the coating is insoluble at room temperature, but soluble at a higher temperature. In another or alternative non-limiting configuration, the surface is or includes PVA or PVB. In another and/or alternative non-limiting configuration, the core includes a reactive binder having a metal fuel and/or oxidizer composite which includes one or more of the following metals: magnesium, zirconium, tantalum, titanium, hafnium, calcium, tungsten, molybdenum, chrome, manganese, silicon, germanium and/or aluminum that is mixed with an oxidizer or thermite pair (e.g., fluorinated or chlorinated polymers such as polytetrafluoroethylene, polyvinylidene difluoride, oxidizers such as bismuth oxide, potassium perchlorate, potassium or silver nitrate, iron oxide, tungsten or molybdenum oxide, and/or intermetallic thermite such as boron, aluminum, or silicon). In another and/or alternative non-limiting configuration, the binder can include an intermetallic reactive material such as iron-aluminum, nickel-aluminum, titanium-boron, and/or other high energy intermetallic couple. In another and/or alternative non-limiting configuration, the binder can include a fuel, oxidizer, and/or a reactive polymeric material. In another and/or alternative non-limiting configuration, the reactive polymeric material can include aluminum-potassium perchlorate-polyvinylidene difluoride and/or tetrafluoroethylene (THV) polymer. The core can be formed by powder metallurgy techniques (e.g., solid state powder sinter-forging, solid state sinter-extrusion, and spark plasma or field assisted sintering in the solid or semi-solid state). The core can alternatively be formed from melt casting, with or without subsequent deformation and heat treatment. The reactive hierarchically-designed component or system can be used to form a variety of structural components (e.g., valve, plug, ball, sleeve, casing etc.) that are designed to corrode/disintegrate or deflagrate under a controlled external stimulus. The reactive hierarchically-designed component or system can be designed to disintegrate over a controlled period of one hour to three weeks (and all values and ranges therebetween), and/or equivalently at a rate of about 0.05-100 mm/hr upon the imparting of a controlled external stimulus of pH, salt content, electrolyte content, electromagnetic waves, sound waves, vibrations, magnetism, pressure, electricity, and/or temperature. The reactive hierarchically-designed component or system can be designed to deflagrate or otherwise combust or react over a certain time period (e.g., one second to 24 hours and all time values or ranges therebetween) upon exposure to an external trigger (e.g., electrical, thermal, magnetic, or hydraulic signal). The trigger can optionally be direct or through a secondary interaction such as, but not limited to, piezoelectric device, breakable capsule, timer, or other intermediate device to convert an external signal to an initiation electrical and/or thermal event. The deflagration of the reactive hierarchically-designed component or system can be utilized to provide thermal energy, clear obstructions, and/or provide local pressure to a location about the hierarchically-designed component or system in a controlled manner. The reaction of the reactive hierarchically-designed component or system can optionally be designed to generate a physical dimensional change, such as swelling (change in density), deformation, bending, and/or shrinkage in the hierarchically-designed component or system during the reaction. In non-limiting application of the reactive hierarchically-designed component or system, composite matrix material and consolidation process used to form the core and/or the complete structure of the hierarchically-designed component or system can be used to enable simultaneous control of compression yield strength and/or control of compressibility modulus for crush and/or extrusion resistance when the hierarchically-designed component or system is contained in an entrapping orifice, and simultaneously also allow for control over the triggering event and the reaction rate of the reactive hierarchically-designed component or system.

In still another non-limiting aspect of the present invention, there is provided a reactive hierarchically-designed component or system that includes a) a core, the core dissolvable, reactive, or combinations thereof in the presence of a fluid environment; and, b) a surface layer that partially or fully encapsulates the core, and wherein the surface layer has a different composition from the core, and wherein the surface layer forms a protective layer about the core to inhibit or prevent the core from dissolving, reacting, or combinations thereof when the component is exposed to the fluid environment, and wherein the surface layer is non-dissolvable in the fluid environment until the surface layer is exposed to an activation event which thereafter causes the surface layer to controllably dissolve and/or degrade in the fluid environment, and wherein the core dissolving, reacting, or combinations thereof after the surface layer dissolves and exposes the core to the fluid environment. At least 70 weight percent of the core optionally includes one or more core materials selected from the group consisting of a metal, a metal alloy, a metal composite and a metal compound. The core material optionally including one or more metals or compounds selected from the group consisting of aluminum, calcium, lithium, magnesium, potassium, sodium, lithium aluminum hydride, sodium aluminum hydride, potassium aluminum hydride, magnesium aluminum hydride, lithium borohydride, sodium borohydride, calcium borohydride, magnesium hydride, n-Al, borohydride mixed with alanates, metal hydrides, borohydrides, and divalent cation alanates. The fluid environment optionally is a water-containing environment. THEThe activation event optionally includes one or more events selected from the group consisting of a temperature change of the fluid environment, a pH change of the fluid environment, exposure of the surface layer with an activation compound, a change in composition of fluid environment, exposure of the surface layer to an electrical charge, exposure to of the surface layer to certain electromagnetic waves, a change in salt content of the fluid environment, a change in electrolyte content of the fluid environment, exposure of the surface layer to certain sound waves, exposure of the surface layer to certain vibrations, exposure of the surface layer to certain magnetic waves, and exposure of the surface layer to a certain pressure. The core optionally has a dissolution rate in the fluid environment of 0.1 and 100 mm/hr at 100-300° F. The surface layer is optionally formulated to be relatively insoluble at a first temperature in the fluid environment and highly soluble in the fluid environment at a second temperature. The surface layer is optionally formulated to be relatively insoluble at a first pH in the fluid environment and highly soluble in the fluid environment at a second pH. The surface layer optionally is chemically modified using a reversible chemical reaction to be insoluble in the fluid environment and soluble in the fluid environment when the chemically modified surface layer is exposed to a chemical compound that is a chemical trigger. The surface layer is optionally chemically modified with a silicon-containing compound. The chemical trigger is optionally a fluorine ion source. There is optionally provided a method for forming the reactive hierarchically-designed component or system as set forth above. There is optionally a method for forming the reactive hierarchically-designed component or system into a structure that can be used for a) separating hydrolic fracturing systems and zones for oil and gas drilling, b) structural support or component isolation in oil and gas drilling and completion systems, or combinations thereof.

In yet another non-limiting aspect of the present invention, there is provided a reactive hierarchically-designed component or system that includes (a) a core having a compression strength above 5000 psig, a density of no more than 1.7 g/cc and a tensile strength of less than 30,000 psig; (b) a high-strength surface layer that has a greater density and higher strength than the core, the surface layer partially of fully encapsulating the core; and wherein the core and the surface layer are provide a high-strength reactive system that also has an overall lower density than approximately 4 g/cc and a strength in the surface layer of at least 35 ksi. The core is optionally a magnesium composite or aluminum composite having a density of 0.9-1.4 g/cc. The surface layer is optionally a zinc alloy. The core optionally has a dissolution rate in a salt water environment of 0.1 and 100 mm/hr at 100-300° F. The surface layer optionally includes a fiber-reinforced metal. There is optionally provided a method for forming the reactive hierarchically-designed component or system as set forth above. There is optionally a method for forming the reactive hierarchically-designed component or system into a structure that can be used for a) separating hydrolic fracturing systems and zones for oil and gas drilling, b) structural support or component isolation in oil and gas drilling and completion systems, or combinations thereof.

In still yet another non-limiting aspect of the present invention, there is provided a reactive hierarchically-designed component or system that includes (a) a core that includes an active material that is reactive in a fluid environment; (b) a propellant located in she core, about the core, or combinations thereof; and, (c) a surface layer that partially or fully encapsulates the core, the propellant, or combinations thereof, and wherein the surface layer has a different composition from the core and the propellant, and wherein the propellant has a different composition from the core, and wherein the surface layer forms a protective layer about the core and the propellant to inhibit or prevent the core and the propellant from dissolving, reacting, or combinations thereof when the component is exposed to the fluid environment, and wherein the surface layer is non-dissolvable in the fluid environment until the surface layer is exposed to an activation event which thereafter causes the surface layer to controllably dissolve and/or degrade in the fluid environment and the core and the propellant dissolving, reacting, or combinations thereof after the surface layer dissolves and/or degrades and exposes the core and/or the propellant to the fluid environment. The propellant optionally includes one or more water-reactive material selected from the group consisting of lithium, sodium, potassium, lithium aluminum hydride, sodium aluminum hydride, potassium aluminum hydride, magnesium aluminum hydride, lithium borohydride, sodium borohydride, calcium borohydride, magnesium hydride, n-Al, borohydride mixed with alanates, metal hydrides, borohydrides, divalent cation alanates, and/or other water-reactive materials. The reaction of the propellant with the fluid environment optionally causes rapid heat generation which in turn causes the core to ignite. The fluid environment optionally is a water-containing environment. The activation event optionally includes one or more events selected from the group consisting of a temperature change of the fluid environment, a pH change of the fluid environment, exposure of the surface layer with an activation compound, a change in composition of fluid environment, exposure of the surface layer to an electrical charge, exposure to of the surface layer to certain electromagnetic waves, a change in salt content of the fluid environment, a change in electrolyte content of the fluid environment, exposure of the surface layer to certain sound waves, exposure of the surface layer to certain vibrations, exposure of the surface layer to certain magnetic waves, and exposure of the surface layer to a certain pressure. The surface layer is optionally formulated to be relatively insoluble at a first temperature in the fluid environment and highly soluble in the fluid environment at a second temperature. The surface layer is optionally formulated to be relatively insoluble at a first pH in the fluid environment and highly soluble in the fluid environment at a second pH. The surface layer is optionally chemically modified using a reversible chemical reaction to be insoluble in the fluid environment and soluble in the fluid environment when the chemically-modified surface layer exposed to a chemical compound that is a chemical trigger. The surface layer optionally is chemically modified with a silicon containing compound. The chemical trigger is optionally a fluorine ion source. The core optionally includes a metal fuel and oxidizer composite which includes one or more mixtures of a reactive metal, an oxidizer, or thermite pair, the reactive metal including one or more metals selected from the group consisting of magnesium, zirconium, tantalum, titanium, hafnium, calcium, tungsten, molybdenum, chrome, manganese, silicon, germanium and aluminum, the oxidizer or thermite pair including one or more compounds selected from the group consisting of fluorinated or chlorinated polymer, oxidizer, and intermetallic thermite. The core optionally includes a binder that includes an intermetallic reactive material that includes a metal material selected from the group consisting of iron-aluminum, nickel-aluminum, titanium-boron, high energy intermetallic couple, or combinations thereof. The binder optionally includes a fuel, an oxidizer, and a reactive polymeric material. The reactive polymeric material optionally includes aluminum-potassium perchlorate-polyvinylidene difluoride or tetrafluoroethylene (THV) polymer. There is optionally provided a method for forming the reactive hierarchically-designed component or system as set forth above. There is optionally a method for forming the reactive hierarchically-designed component or system into a structure that can be used for a) separating hydrolic fracturing systems and zones for oil and gas drilling, b) structural support or component isolation in oil and gas drilling and completion systems, or combinations thereof.

In another non-limiting aspect of the present invention, there is provided a reactive hierarchically-designed component or system that is formed in to structural material that is designed to corrode/disintegrate or deflagrate under a controlled external stimulus. The structural material is optionally designed to disintegrate over a controlled period of one hour to one month or at a rate of about 0.1 to 100 mm/hr upon the imparting of a controlled external stimulus to the structural component. The structural material is optionally designed to deflagrate or otherwise combust or react over a one-second to one-hour period upon an external trigger, and wherein the deflagration is utilized to provide thermal energy, clear obstructions, provide local pressure, or combinations thereof in a controlled manner. The reaction is optionally designed to generate a physical dimensional change, deformation, bending, shrinkage, or combinations thereof.

In one non-limiting object of the present invention, there is provided a component or system that can be controllably disintegrated.

In another and/or alternative non-limiting object of the present invention, there is provided a component or system that can be used in a well operation that can be controllably disintegrated.

In still another and/or alternative non-limiting object of the present invention, there is provided a component or system that can include a core material having a surface or protective layer and which component or system can be stored for long periods of time unless activated.

In yet another and/or alternative non-limiting object of the present invention, there is provided a component or system that can include a core material having a surface or protective layer and which component or system has controlled reaction kinetics that can be catalyzed by an external stimulus.

In still yet another and/or alternative non-limiting object of the present invention, there is provided a component or system that can include a core material having a surface or protective layer and which component or system has a reactive composite system that is inert or essentially inert unless initiated by a certain temperatures, electromagnetic waves, sound waves, vibrations, chemicals, liquids, gasses, electromagnetic waves, pH, salt content, exposure electrolyte content, magnetism, pressure, and/or exposure to electricity and/or other external stimulus after which it disintegrates in a controlled and repeatable manner.

In another and/or alternative non-limiting object of the present invention, there is provided a component or system that can include a core material having a surface or protective layer and which component or system has a hierarchically-designed component or system that includes a core and a surface which are designed to react and/or activate under different conditions.

In still another and/or alternative non-limiting object of the present invention, there is provided a component or system that can include a core material having a surface or protective layer and which component or system has a core material is designed to have a high reaction rate that disintegrates when exposed to certain environments (liquids, gasses, temperatures, electromagnetic waves, vibrations, and/or sound waves, pH, salt content, electrolyte content, magnetism, pressure, and/or temperature, etc).

In yet another and/or alternative non-limiting object of the present invention, there is provided a component or system that can include a core material having a surface or protective layer and which component or system has a core material is designed to generate heat when exposed to various environments (e.g., liquids, gasses, temperatures, electromagnetic waves, vibrations, and/or sound waves, pH, salt content, electrolyte content, magnetism, pressure, electricity, and/or temperature, etc.).

In still yet another and/or alternative non-limiting object of the present invention, there is provided a component or system that can include a core material having a surface or protective layer and which component or system has a core material is formed of one or more layers.

In another and/or alternative non-limiting object of the present invention, there is provided a component or system that can include a core material having a surface or protective layer and which component or system has a core material that is partially or fully surrounded by one or more surface or protective layers that inhibits or prevents the core from reacting and/or disintegrating until a desired time or event.

In still another and/or alternative non-limiting object of the present invention, there is provided a component or system that can include a core material having a surface or protective layer and which component or system has one or more surfaces or protective layers that are designed to be inert unless exposed to an activation event or condition, which activation event or condition could be, but are not limited to, temperature, electromagnetic waves, sound waves, certain chemicals, and/or pH.

In yet another and/or alternative non-limiting object of the present invention, there is provided a component or system that can include a core material having a surface or protective layer and in which each layer of the component or system has a different function in the component or system.

In still yet another and/or alternative non-limiting object of the present invention, there is provided a component or system that can be used as a dissolvable, degradable and/or reactive structure in oil drilling. For example, the component or system of the present invention can be used to form a frac ball or other structure in a well drilling or completion operation such as a structure that is seated in a hydraulic operation that can be dissolved away after use so that that no drilling or removal of the structure is necessary. Other types of structures can include, but are not limited to, sleeves, valves, hydraulic actuating tooling and the like. Such non-limiting structures or additional non-limiting structure are illustrated in U.S. Pat. No. 8,905,147; U.S. Pat. No. 8,717,268; U.S. Pat. No. 8,663,401; U.S. Pat. No. 8,631,876; U.S. Pat. No. 8,573,295; U.S. Pat. No. 8,528,633; U.S. Pat. No. 8,485,265; U.S. Pat. No. 8,403,037; U.S. Pat. No. 8,413,727; U.S. Pat. No. 8,211,331; U.S. Pat. No. 7,647,964; US 2013/0199800; US 2013/0032357; US 2013/0029886; US 2007/0181224; and WO 2013/122712; all of which are incorporated herein by reference.

These and other objects, features and advantages of the present invention will become apparent in light of the following detailed description of preferred embodiments thereof, as illustrated in the accompanying drawings.

DETAILED DESCRIPTION OF THE INVENTION

Referring now to the figures wherein the showings illustrate non-limiting embodiments of the present invention, the present invention is directed to the formation and use of disintegrating components and materials that can be stored for long periods of time until activated. The present invention also relates to the production of a reactive hierarchically-designed component or system having controlled reaction kinetics that can be catalyzed by an external stimulus. The invention further relates to a reactive hierarchically-designed component or system that is inert or essentially inert unless initiated by a certain temperature, pH, and/or other external stimulus after which it disintegrates in a controlled and repeatable manner. The components of the present invention have particular applicability to components used in the forming of wells; however, it will be appreciated that the components of the present invention can be used in many other industries and applications.

Figure 1:
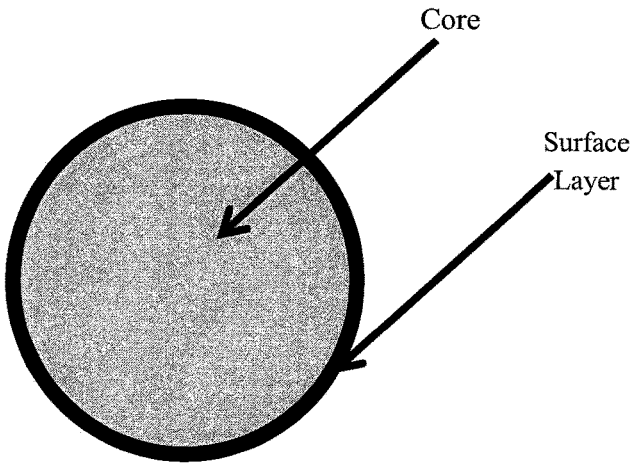
FIGS. 1-2 are a cross-sectional illustration of layered ball actuators in accordance with the present invention wherein the core represents a disintegrating high strength material.
Figure 2:
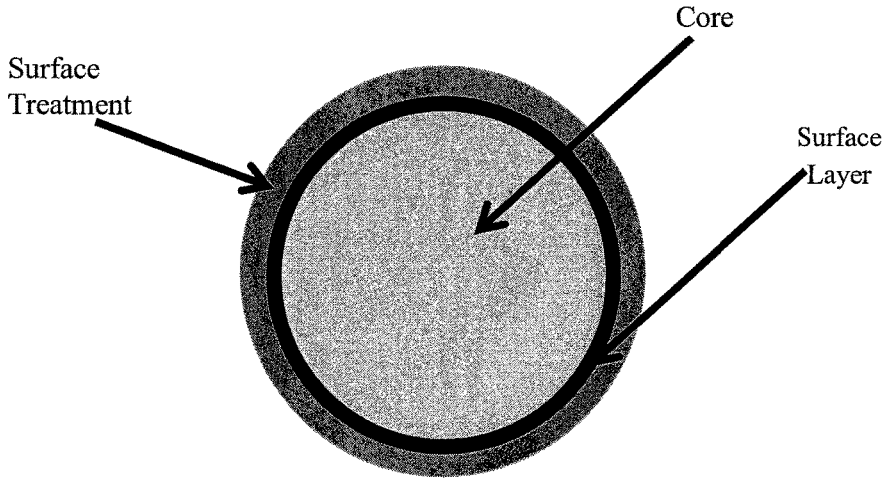

Referring to FIGS. 1-2, there are cross-sectional illustrations of layered composite ball actuators in accordance with the present invention wherein the core represents a disintegrating high strength composite. The cross-sectional shape of the core illustrated as being circular; however, it can be appreciated that the core can have any shape.

In one non-limiting configuration, the core can be formed of a metal such as, but not limited to, lithium, sodium, magnesium, magnesium-carbon-iron composite system, and the like. As can be appreciated, the core can also or alternatively include a polymer material. The core can be formed or more than one type of material; however, that is not required. The core can be formed of one or more layers. When the core includes two or more layers, the layers are generally formed of different materials; however, this is not required. The surface layer of the composite ball actuator can include a protective or delay coating. The surface layer can be a metal layer, a polymer layer, and/or a ceramic layer. The surface layer can be formed of one or more layers.

When the surface layer includes two or more layers, the layers are generally formed of different materials; however, this is not required.

In one non-limiting arrangement, the surface layer can be a temperature-sensitive polymer such as, but not limited to, PVA, that is inert and insoluble until exposed to certain environmental conditions. For example, when the surface layer is PVA, and when the PVA reaches a critical temperature in water, the PVA dissolves to expose the underlying reactive core, thereby causing the core to react. Surface layers that activate under exposure to specific temperatures, pressures, fluids, electromagnetic waves and/or mechanical environments to delay the initiation of a dissolution reaction are envisioned by the present invention.

In accordance with the present invention, a metal, metal alloy, metal matrix composite, polymer, or polymer composite having a specified reactive function can form all or part of the core. One of the primary functions of the core is for the material of the core to partially or fully disintegrate in a controlled and uniform manner upon exposure an environmental condition (e.g., exposure to saltwater, etc.). On the surface of the core (which core can be a casting, forging, extrusion, pressed, molded, or machined part), a surface layer is included to modify the conditions to which the core will react. In one non-limiting configuration, the core has a strength above 25,000 psig, and is selected to respond to a set of environmental conditions to perform a function (e.g., react, dissolve, corrode, fracture, generate heat, etc.).

In one non-limiting formulation, the core can be or include magnesium or magnesium alloy that has a temperature-dependent dissolution or disintegration rate. This disintegration rate of the core can be designed such that the core dissolves, corrodes, reacts, and/or chemically reacts in a certain period of time at a given temperature. One non-limiting application that can use such a core is a frac ball. The composite system can be designed such that the core does not disintegration at a temperature of less than about 100° F. via protection from the surface layer. As can be appreciated, the temperature can be any temperature (e.g., below 10° F., below 50° F., below 100° F., below 150° F., below 200° F., etc.). In one embodiment, wherein the hierarchically-designed component or system is designed to inhibit or prevent reaction of the core at a temperature below 100° F., the core would have a near-infinite life at conditions below 100° F. To accomplish this non-limiting embodiment, the hierarchically-designed component or system has a surface layer that is applied to the surface of the core, wherein the surface layer is inert under conditions wherein the temperature is below 100° F., but dissolves, corrodes, or degrades once the temperature exceeds 100° F. (e.g., dissolves, corrodes, or degrades in the presence of water that exceeds 100° F., dissolves, corrode, or degrades in the present of air that exceeds 100° F., etc.) In this non-limiting embodiment, the kinetics of the reaction can be changed by inhibiting the initial reaction, and then accelerating the reaction once specific conditions are met. As can be appreciated, the surface layer can be caused to dissolve, corrode, or degrade upon exposure to other conditions (e.g., certain liquids, certain gasses, certain temperatures, certain electromagnetic waves, certain vibrations, and/or certain sound waves, certain pH, certain salt content, certain electrolyte content, certain magnetism, certain pressure, electricity, and/or certain temperature, etc.).

Because the surface layer may be exposed to high stress, surface layer can be thin (e.g., 0.01-50 mils, typically 0.01-10 mils, more typically 0.01-5 mils, etc.); however, this is not required. Alternatively, the surface layer can be designed to be strong and to contribute mechanically to the system, such as through the use of fiber, flakes, metals, metal alloys, and/or whisker reinforcement in the layer. The thickness of the surface layer about the core can be uniform or vary.

Example 1

A magnesium frac ball is produced having a disintegration rate of about 0.7-1.4 mm/hr at 200° F. and about 0.01-0.04 mm/hr at 100° F. The frac ball is designed to able to withstand at least a 24-hour exposure to 80° F. water in a ball drop system. The magnesium core can be magnesium, magnesium alloy or a magnesium composite. As can be appreciated, the core can be formed of other metals and/or non-metals that react, dissolve, corrode, or disintegrate at a rate of 0.1-100 mm/hr at 100-300° F. in water or salt water. The magnesium frac ball can be undermachined by 0.001-0.2" (e.g., 0.005", etc.) from final dimensions, and a 0.001-0.2" coating (e.g., 0.005" coating, etc.) of PVA can be applied to the surface through a spray-coating process. FIG. 1 illustrates one non-limiting configuration of the frac ball. Although not illustrated in FIG. 1, the core can be formed of multiple layers of material wherein each layer has a different composition from the adjacently positioned layer. For example, the first or central layer of the core could include a magnesium composite material, and a second layer that is applied about the first layer could be magnesium or magnesium alloy. Likewise, the surface layer can include one or more different layers wherein each layer has a different composition from the adjacently positioned layer. The thickness of the two or more layers of the surface layer (when used) can be the same or different. Likewise, the thickness of the two or more layers of the core (when used) can be the same or different. The PVA is very insoluble in water up to about 130-150° F. At temperatures above 150° F., the PVA becomes dissolvable and ultimately exposes the magnesium core. The magnesium frac ball has excellent mechanical properties (e.g., generally above 30 ksi strength), and when the magnesium frac ball is exposed to slightly acidic or salt solutions, the magnesium frac ball corrodes at a rate of about 0.1-15 mm/day. However, when the magnesium frac ball is exposed to temperatures below about 130° F., the magnesium frac ball does not dissolve or corrode. As can be appreciated, the thickness of the coating of PVA can be selected to control the time needed for the PVA to dissolve and thereby expose the core to the surrounding environment.

Example 2

A high-strength frac ball is produced using a low-density core, which frac ball is selected for having good compressive strength and low density, and having a surface layer of a higher tensile strength and a denser material than the core. The core is selected from a magnesium composite that uses a high corrosion magnesium alloy matrix with carbon, glass, and/or ceramic microballoons or balls to reduce its density to below 1.7 g/cc (e.g., 0.5-1.66 g/cc and all values and ranges therebetween) and typically below about 1.3 g/cc. As can be appreciated, other densities of the core can be used. This composite core has very good compressive strengths, but tensile strengths may, in some applications, be inadequate for the intended application. For example, the tensile strength of the composite core may be less than 35 ksi, typically less than 32 ksi, and more typically less than 30 ksi. As such, the composite core can be surrounded by another layer having a greater tensile strength. This surrounding layer can have a thickness of about 0.035-0.75" (and all values and ranges therebetween) and typically about 0.1-0.2". The surrounding layer can be formed of magnesium, magnesium alloy or a high-strength magnesium composite. The high strength outer layer is designed to have adequate tensile strength and toughness for the applications, and generally has a tensile strength that is greater than 33 ksi, typically greater than 35 ksi, and more typically greater than 45 ksi; however, the tensile strength can have other values. The resultant component can have an overall density of about 5-45% lower (and all values and ranges therebetween) than a pure magnesium alloy ball, and typically about 30% lower than a pure magnesium alloy ball, but also has the high tensile and shear strengths needed to perform the desired ball actuator application.

The core of the high-strength frac ball can be heat treated and machined after fabrication. A surface layer can optionally be applied to the core using thermal spray, co-extrusion, casting, or through power metallurgy techniques suitable for its fabrication as discussed in Example 1.

Example 3

A magnesium frac ball is produced having a disintegration rate of about 0.7-1.4 mm/hr at 200° F. and about 0.01-0.04 mm/hr at 100° F. The frac ball is designed to be able to withstand at least a 24-hour exposure to 80° F. water in a ball drop system. The magnesium frac ball can be undermachined by 0.001-0.2" (e.g., 0.005", etc.) from final dimensions, and a 0.001-0.2" coating (e.g., 0.005" coating, etc.) of zinc metal can be applied to the surface of the magnesium core. The magnesium core can be magnesium, magnesium alloy or a magnesium composite. As can be appreciated, the core can be formed of other metal and/or non-metals that react, corrode, dissolve or disintegrate at a rate of 0.1-100 mm/hr at 100-300° F. in water or salt water. The resultant compact has high mechanical properties, generally about 28 ksi and typically above 30 ksi strength (e.g., 30-45 ksi and all values and ranges therebetween). When the core of the magnesium frac ball is exposed to salt solutions, the magnesium frac ball corrodes at a rate of about 0.1-15 mm/day depending on the environment and temperature. The magnesium frac ball is designed to not react or corrode until activated with an acid exposure that removes the zinc surface layer and exposes the underlying magnesium core.

Example 4

A high-strength frac ball is produced using a low-density core, which frac ball is selected for having good compressive strength and low density, and having a surface layer of a higher tensile strength, and a denser material than the core. The core is selected from a magnesium composite that uses a high corrosion magnesium alloy matrix with carbon, glass, and/or ceramic microballoons or balls to reduce its density to below 1.7 g/cc (e.g., 0.5-1.66 g/cc and all values and ranges therebetween) and typically below about 1.3 g/cc. As can be appreciated, other densities of the core can be used. This composite core has very good compressive strengths, but tensile strengths may, in some applications, be inadequate for the intended application. For example, the tensile strength of the composite core may be less than 35 ksi, typically less than 32 ksi, and more typically less than 30 ksi. As such, the composite core can be surrounded by another layer having a greater tensile strength. Surrounding the composite core is high-strength metal or metal alloy (e.g., zinc, etc.) that has a layer thickness of about 0.035-0.75", and typically about 0.1-0.2". The high-strength metal or metal alloy outer layer is designed to have adequate tensile strength and toughness for certain the applications, and is generally greater than 33 ksi, typically greater than 35 ksi, and more typically greater than 45 ksi; however, the tensile strength can have other values. The resultant component can have an overall density of about 5-60% lower (and all values and ranges therebetween) than a pure zinc alloy ball, and typically about 50% lower than a pure zinc alloy ball, but also has the high tensile and shear strengths needed to perform the desired ball actuator application.

Example 5

A reactive material containing a water-reactive substance such as, but not limited to, lithium, is formed into a particle. The lithium is added to a propellant mixture. The propellant mixture can include polyvinylidene difluoride (PVDF), ammonium nitrate, and/or aluminum to form a gas-generating composition. The lithium particle can optionally include a polymer coating (e.g., PVA, etc.) that is applied to its surface to protect it from contact with water. The polymer coating is formulated to be insoluble at room temperature, but can dissolve in hot water (e.g., +140° F.). Once the coating is dissolved to expose the lithium, the lithium reacts with water and releases heat, thus igniting the propellant (e.g., aluminum-ammonium nitrate-PVDF propellant, etc.) to generate heat and gas pressure. As can be appreciated, other reactive particles can be used (e.g., lithium, sodium, potassium, lithium aluminum hydride, sodium aluminum hydride, potassium aluminum hydride, magnesium aluminum hydride, lithium borohydride, sodium borohydride, calcium borohydride, magnesium hydride, n-Al, borohydride mixed with alanates, metal hydrides, borohydrides, divalent cation alanates, and/or other water-reactive materials, etc.).

Example 6

A reactive material containing a water-reactive substance such as, but not limited to, sodium, is formed into a particle. The sodium is added to a propellant mixture. The propellant mixture can include PVDF, ammonium nitrate, and/or aluminum to form a gas-generating composition. The sodium particle can optionally include a polymer coating (e.g., PVAP, etc.) that is applied to its surface to protect it from contact with water. The polymer can optionally be a polymer that is insoluble in water-containing environments having an acidic pH, but is soluble in neutral or basic water containing environments; however, this is not required. One such polymer is polyvinyl acetate phthalate (PVAP). As can be appreciated, the polymer can optionally be selected to be insoluble in water-containing environments having a basic or neutral pH, but is soluble in an acidic water-containing environments; however, this is not required. The reactive material can be pumped into a formation using a solution having a pH wherein the polymer does not dissolve or degrade. Once the reactive material is in position, the pH solution can be changed to cause the polymer to dissolve or degrade, thereby exposing the sodium to the water and thus igniting the propellant by the heat generated by the sodium exposure to water to thereby generate localized heat and pressure. As can be appreciated, other reactive particles can be used (e.g., lithium, sodium, potassium, lithium aluminum hydride, sodium aluminum hydride, potassium aluminum hydride, magnesium aluminum hydride, lithium borohydride, sodium borohydride, calcium borohydride, magnesium hydride, n-Al, borohydride mixed with alanates, metal hydrides, borohydrides, divalent cation alanates, and/or other water-reactive materials, etc.).

Example 7

A magnesium frac ball is produced having a disintegration rate of about 0.7-1.4 mm/hr at 200° F. and about 0.01-0.04 mm/hr at 100° F. The frac ball is designed to able to withstand at least one day, typically at least seven days, and more typically at least 14 days exposure to 80° F.+ water or a water system having an acidic pH in a ball drop system or a down hole application (e.g., ball/ball seat assemblies, fracture plugs, valves, sealing elements, well drilling tools, etc.). The magnesium core can be magnesium, magnesium alloy or a magnesium composite. As can be appreciated, the core can be formed of other metal and/or non-metals that react, corrode, dissolve or disintegrate at a rate of 0.1-100 mm/hr at 100-300° F. in water or salt water. The magnesium frac ball can be undermachined by 0.001-0.2" (e.g., 0.005", etc.) from final dimensions, and a 0.001-0.2" coating (e.g., 0.005" coating, etc.) of PVA can be applied to the surface through a spray-coating process. The PVA is very insoluble in water up to about 130-150° F. At temperatures above 150° F., the PVA becomes dissolvable. To prevent dissolution of the PVA above 150° F., the PVA coating is modified with a silicone component such as, but not limited to, trimethylsilyl group to convert the PVA to a protected ether silyl layer that is insoluble in water, salt water, and acidic water solutions, even when such solutions exceed 150° F. Non-limiting examples of compounds that include the trimethylsilyl group include trimethylsilyl chloride, bis(trimethylsilyl)acetamide, trimethylsilanol, and tetramethylsilane. FIG. 2 illustrates an example of a surface treatment layer such as compound having a trimethylsilyl group that is applied to the outer surface of a surface layer of PVA, and wherein the PVA surrounds a core. The converted PVA can be converted back to PVA (e.g., the protected ether silyl is removed from the PVA) by exposing the converted PVA to an ammonium fluoride solution or similar solution which thereby converts the surface back to PVA. At temperatures above 150° F., the PVA becomes dissolvable and ultimately exposes the magnesium core. The magnesium frac ball has excellent mechanical properties (e.g., generally above 30 ksi strength), and when the magnesium frac ball is exposed to slightly acidic or salt solutions, the magnesium frac ball corrodes at a rate of about 0.1-15 mm/day. However, when the magnesium frac ball is exposed to temperatures below about 130° F., the magnesium frac ball does not dissolve or corrode. As can be appreciated, the thickness of the coating of PVA can be selected to control the time needed for the PVA to dissolve and thereby expose the core to the surrounding environment. Also as can be appreciated, the modification of the coating of PVA can be selected to achieve control of exposure of the core to the surrounding environment.

Example 8

A silicone coating (e.g., polymer-based siloxane two-part coating) was sprayed onto a dissolvable metal sphere and cured for seven days. The dissolvable metal sphere can be formed of magnesium, magnesium alloy, a magnesium composite or metal and/or non-metals that react, corrode, dissolve or disintegrate at a rate of 0.1-100 mm/hr at 100-300° F. in water or salt water. The coating thickness was about 0.003"; however, the coating thickness can be other thicknesses (e.g., 0.001-0.1" and any value or range therebetween, etc.). The coated ball was then submersed in 200° F. of HCl (e.g., 0.1-3M HCl) for 65 min with no evidence of reaction of the metal sphere. 0.1 M HF was thereafter added to the 200° F. HCl solution (e.g., 0.1-3M HCl) and the silicone coating separated from the metal sphere in less than 30 minutes (e.g., 0.1-30 minutes and all values and ranges therebetween). The silicone coating is generally formulated to separate from the metal sphere when exposed to certain solutions in about 0.1-180 minutes (and all values and ranges therebetween), depending on the type, concentration and temperature of the solution. The metal that was dissolvable then started dissolving in the HCl solution. In another example, the same silicone polymer was sprayed onto a dissolvable metal plate and cured for seven days. The dissolvable metal plate can be formed of magnesium, magnesium alloy, a magnesium composite or metal and/or non-metals that react, corrodes, dissolves or disintegrate at a rate of 0.1-100 mm/hr at 100-300° F. in water or salt water. The coating thickness was about 0.006". The coated plate was then subjected to a simulated pipe line sliding wear equivalent to 5000 feet of sliding wear. The silicone coating exhibited little or no removal of material and the dissolvable metal plate was not exposed to any sliding wear.

Example 9

A polymer-based polyurethane coating (e.g., one-or two-part coating) was applied (e.g., electrostatically, etc.) to the surface of a dissolvable metal sphere and cured above 300° F. for about 15 min. The dissolvable metal sphere can be formed of magnesium, magnesium alloy, a magnesium composite or metal and/or non-metals that react, corrode, dissolve or disintegrate at a rate of 0.1-100 mm/hr at 100-300° F. in water or salt water. The coated sphere was cooled to room temperature and submerged in 80° F. 15% HCl solution (i.e., 2.75M HCl) for 60 min. No degradation of the coating or ball was observed and no dimensions changed. The coated sphere was then moved to a 200° F. 3% KCl solution (i.e., 0.4M KCl). The coating started to degrade after about 30 minutes at the elevated temperature and the dissolvable metal sphere thereafter degraded with the removal of the silicone coating. The silicone coating is generally formulated to separate from the metal sphere when exposed to certain solutions in about 0.1-180 minutes (and all values and ranges therebetween), depending on the type, concentration and temperature of the solution.

Example 10

A polymer-based PVB coating was coated (e.g., electrostatically applied, etc.) to the surface of a dissolvable metal sphere and cured above 300° F. for about 30 minutes. The dissolvable metal sphere can be formed of magnesium, magnesium alloy, a magnesium composite or metal and/or non-metals that reacts, corrode, dissolves or disintegrates at a rate of 0.1-100 mm/hr at 100-300° F. in water or salt water. The coating was abrasion resistant and had excellent adhesion to the sphere. The coated sphere was cooled to room temperature and submerged in 80° F. 15% HCl solution for about 60 minutes. No degradation of the coating or metal sphere was observed and the coated sphere did not exhibit any dimensional changes. The coated sphere was then moved to a 200° F. 3% KCl solution. The coating on the metal sphere started to degrade after about 30 min at the elevated temperature and the dissolvable metal sphere degraded with the removal of the PVB. The PVB coating is generally formulated to separate from the metal sphere when exposed to certain solutions in about 0.1-180 minutes (and all values and ranges therebetween), depending on the type, concentration and temperature of the solution.

Example 11

A polymer-based PVB coating was coated (e.g., coated using a solvent, etc.) to the surface of a dissolvable metal sphere and cured above 300° F. for about 30 minutes. The dissolvable metal sphere can be formed of magnesium, magnesium alloy, a magnesium composite or metal and/or non-metals that react, corrode, dissolve or disintegrate at a rate of 0.1-100 mm/hr at 100-300° F. in water or salt water. The coating was abrasion resistant and had excellent adhesion to the sphere. The coated sphere was cooled to room temperature and submerged in 80° F. 15% HCl solution for about 60 minutes. No degradation of the coating or metal sphere was observed and the coated sphere did not exhibit any dimensional changes. The coated sphere was then moved to a 200° F. 3% KCl solution. The coating on the metal sphere started to degrade after about 30 minutes at the elevated temperature and the dissolvable metal sphere degraded with the removal of the PVB. The PVB coating is generally formulated to separate from the metal sphere when exposed to certain solutions in about 0.1-180 minutes (and all values and ranges therebetween), depending on the type, concentration and temperature of the solution.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall there between. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims.

What is claimed:

1. A hierarchically-designed reactive component comprising:

a. a core, said core dissolvable, reactive, or combinations thereof in the presence of a fluid environment, at least 70 weight percent of said core includes a core material selected from the group consisting of aluminum, calcium, lithium, magnesium, potassium, sodium, lithium aluminum hydride, sodium aluminum hydride, potassium aluminum hydride, magnesium aluminum hydride, lithium borohydride, sodium borohydride, calcium borohydride, magnesium hydride, n-Al, borohydride mixed with alanates, metal hydrides, borohydrides, and divalent cation alanates; and, b. a surface layer that partially or fully encapsulates said core, said surface layer having a different composition from said core, said surface layer includes a polymer, said surface layer forming a protective layer about said core to inhibit or prevent said core from dissolving, reacting, or combinations thereof when said component is exposed to said fluid environment, said surface layer non-dissolvable in said fluid environment until said surface layer is exposed to an activation event which thereafter causes said surface layer to controllably dissolve in said fluid environment and said core dissolving, reacting, or combinations thereof after said surface layer dissolves and exposes said core to said fluid environment, said surface layer includes a chemically-modified composition that is formulated to have a reversible chemical reaction when exposed to a chemical trigger, said surface layer formulated to be insoluble in said fluid environment and soluble in said fluid environment when chemically modified by said chemical trigger.

2. The component as defined in claim 1, wherein said fluid environment is a water-containing environment.

3. The component as defined in claim 1, wherein said activation event includes one or more events selected from the group consisting of a temperature change of said fluid environment, a pH change of said fluid environment, exposure of said surface layer with an activation compound, a change in composition of fluid environment, exposure of said surface layer to an electrical charge, exposure to of said surface layer to certain electromagnetic waves, a change in salt content of said fluid environment, a change in electrolyte content of said fluid environment, exposure of said surface layer to certain sound waves, exposure of said surface layer to certain vibrations, exposure of said surface layer to certain magnetic waves, and exposure of said surface layer to a certain pressure.

4. The component as defined in claim 1, wherein said core has a dissolution rate in said fluid environment of 0.1 and 100 mm/hr at 100-300° F.

5. The component as defined in claim 1, wherein surface layer is formulated to be relatively insoluble at a first temperature in said fluid environment and highly soluble in said fluid environment at a second temperature.

6. The component as defined in claim 1, wherein surface layer is formulated to be relatively insoluble at a first pH in said fluid environment and highly soluble in said fluid environment at a second pH.

7. A hierarchically-designed reactive component comprising:

a. a core, said core dissolvable, reactive, or combinations thereof in the presence of a fluid environment; and, b. a surface layer that partially or fully encapsulates said core, said surface layer having a different composition from said core, said surface layer forming a protective layer about said core to inhibit or prevent said core from dissolving, reacting, or combinations thereof when said component is exposed to said fluid environment, said surface layer non-dissolvable in said fluid environment until said surface layer is exposed to an activation event which thereafter causes said surface layer to controllably dissolve in said fluid environment and said core dissolving, reacting, or combinations thereof after said surface layer dissolves and exposes said core to said fluid environment, said surface layer includes a chemically modified composition that is formulated to have a reversible chemical reaction when exposed to a chemical trigger, said surface layer formulated to be insoluble in said fluid environment and soluble in said fluid environment when chemically modified by said chemical trigger, said chemically modified composition includes a silicon-containing compound.

8. The component as defined in claim 1, wherein said chemical trigger is a fluorine ion source.

9. The component as defined in claim 1, wherein at least 95 weight percent of said core includes one or more core materials selected from the group consisting of aluminum, calcium, lithium, magnesium, potassium, sodium, lithium aluminum hydride, sodium aluminum hydride, potassium aluminum hydride, magnesium aluminum hydride, lithium borohydride, sodium borohydride, calcium borohydride, magnesium hydride, n-Al, borohydride mixed with alanates, metal hydrides, borohydrides, and divalent cation alanates.

10. The component as defined in claim 9, wherein said core material is formed of magnesium, magnesium alloy, magnesium composite, or aluminum alloy that includes greater than 75 weight percent aluminum, calcium, Ca—Mg alloy, Ca—Al alloy, Ca—Zn alloy or zinc alloy.

11. The component as defined in claim 10, wherein said core material is formed of magnesium, magnesium alloy or magnesium composite having a dissolution rate in salt-containing water of 0.1-100 mm/hr. at 100-300° F.

12. The component as defined in claim 1, wherein said surface layer includes one or more materials selected from the group consisting of ethylene-α-olefin copolymer, linear styrene-isoprene-styrene copolymer, ethylene-butadiene copolymer, styrene-butadiene-styrene copolymer, copolymer having styrene endblocks and ethylene-butadiene or ethylene-butene midblocks, copolymer of ethylene and alpha olefin, ethylene-octene copolymer, ethylene-hexene copolymer, ethylene-butene copolymer, ethylene-pentene copolymer, ethylene-butene copolymer, polyvinyl alcohol, polyvinyl butyral, silicone-based coating, and polyurethane-based coating.

13. The component as defined in claim 9, wherein said surface layer includes one or more materials selected from the group consisting of ethylene-α-olefin copolymer, linear styrene-isoprene-styrene copolymer, ethylene-butadiene copolymer, styrene-butadiene-styrene copolymer, copolymer having styrene endblocks and ethylene-butadiene or ethylene-butene midblocks, copolymer of ethylene and alpha olefin, ethylene-octene copolymer, ethylene-hexene copolymer, ethylene-butene copolymer, ethylene-pentene copolymer, ethylene-butene copolymer, polyvinyl alcohol, polyvinyl butyral, silicone-based coating, and polyurethane-based coating.

14. The component as defined in claim 10, wherein said surface layer includes one or more materials selected from the group consisting of ethylene-α-olefin copolymer, linear styrene-isoprene-styrene copolymer, ethylene-butadiene copolymer, styrene-butadiene-styrene copolymer, copolymer having styrene endblocks and ethylene-butadiene or ethylene-butene midblocks, copolymer of ethylene and alpha olefin, ethylene-octene copolymer, ethylene-hexene copolymer, ethylene-butene copolymer, ethylene-pentene copolymer, ethylene-butene copolymer, polyvinyl alcohol, polyvinyl butyral, silicone-based coating, and polyurethane-based coating.

15. The component as defined in claim 12, wherein said surface layer includes polyvinyl alcohol, polyvinyl alcohol modified with a silicone component, polyvinyl acetate phthalate, silicone, polymer-based polyurethane, polymer-based polyvinyl butyral.

16. The component as defined in claim 13, wherein said surface layer includes polyvinyl alcohol, polyvinyl alcohol modified with a silicone component, polyvinyl acetate phthalate, silicone, polymer-based polyurethane, polymer-based polyvinyl butyral.

17. The component as defined in claim 14, wherein said surface coating includes polyvinyl alcohol, polyvinyl alcohol modified with a silicone component, polyvinyl acetate phthalate, silicone, polymer-based polyurethane, polymer-based polyvinyl butyral.

18. A hierarchically-designed reactive component comprising:

a. a core, said core dissolvable, reactive, or combinations thereof in the presence of a fluid environment, said core including at least 70 weight percent magnesium; and, b. a surface layer that partially or fully encapsulates said core, said surface layer having a different composition from said core, said surface layer forming a protective layer about said core to inhibit or prevent said core from dissolving, reacting, or combinations thereof when said component is exposed to said fluid environment, said surface layer non-dissolvable in said fluid environment until said surface layer is exposed to an activation event which thereafter causes said surface layer to controllably dissolve in said fluid environment and said core dissolving, reacting, or combinations thereof after said surface layer dissolves and exposes said core to said fluid environment, said surface layer includes a metal, a polymer, or combinations thereof, said surface layer having a different composition from said core, said surface layer includes a chemically modified composition that is formulated to have a reversible chemical reaction when exposed to a chemical trigger, said surface layer formulated to be insoluble in said fluid environment and soluble in said fluid environment when chemically modified by said chemical trigger.

19. The component as defined in claim 18, wherein said surface layer includes one or more materials selected from the group consisting of zinc, zinc alloy, ethylene-α-olefin copolymer, linear styrene-isoprene-styrene copolymer, ethylene-butadiene copolymer, styrene-butadiene-styrene copolymer, copolymer having styrene endblocks and ethylene-butadiene or ethylene-butene midblocks, copolymer of ethylene and alpha olefin, ethylene-octene copolymer, ethylene-hexene copolymer, ethylene-butene copolymer, ethylene-pentene copolymer, ethylene-butene copolymer, polyvinyl alcohol, polyvinyl butyral, silicone-based coating, and polyurethane-based coating.

20. The component as defined in claim 19, wherein said surface coating includes polyvinyl alcohol, polyvinyl alcohol modified with a silicon-containing compound, polyvinyl acetate phthalate, silicone, polymer-based polyurethane, polymer-based polyvinyl butyral.

21. The component as defined in claim 20, wherein said surface layer is modified with said silicon-containing compound.

22. The component as defined in claim 18, wherein said chemical trigger is a fluorine ion source.

23. The component as defined in claim 19, wherein said chemical trigger is a fluorine ion source.

24. The component as defined in claim 20, wherein said chemical trigger is a fluorine ion source.

25. The component as defined in claim 21, wherein said chemical trigger is a fluorine ion source.

* * * * *